US008308032B2

(12) United States Patent
Guerreschi

(10) Patent No.: US 8,308,032 B2
(45) Date of Patent: Nov. 13, 2012

(54) MACHINE FOR FORMING AND IRONING FOLDS IN PIECES OF CLOTH

(75) Inventor: Carlo Guerreschi, Ca' di David (IT)

(73) Assignee: Vi.Be.Mac. S.p.A., San Giovanni Lupatoto (Verona) (IT)

( * ) Notice: Subject to any disclaimer, the term of this patent is extended or adjusted under 35 U.S.C. 154(b) by 156 days.

(21) Appl. No.: 13/027,454

(22) Filed: Feb. 15, 2011

(65) Prior Publication Data

US 2011/0204104 A1 Aug. 25, 2011

(30) Foreign Application Priority Data

Feb. 19, 2010 (IT) ..... VR2010A0032

(51) Int. Cl.
*A41H 33/00* (2006.01)
*A41H 15/00* (2006.01)

(52) U.S. Cl. ..... 223/38

(58) Field of Classification Search ..... 223/37, 223/38; 112/470.06, 470.09, 470.14, 470.18
See application file for complete search history.

(56) References Cited

U.S. PATENT DOCUMENTS

| | | | | | |
|---|---|---|---|---|---|
| 2,609,129 | A | * | 9/1952 | Goldberg | 223/38 |
| 2,858,967 | A | * | 11/1958 | Gilbert | 223/38 |
| 3,093,275 | A | * | 6/1963 | Silverman | 223/38 |
| 3,220,621 | A | | 11/1965 | Freeman | |
| 3,491,926 | A | | 1/1970 | Tucci | |
| 5,074,230 | A | * | 12/1991 | Morii et al. | 112/470.14 |
| 5,454,336 | A | * | 10/1995 | Iwasaki | 112/470.16 |

FOREIGN PATENT DOCUMENTS

| | | |
|---|---|---|
| DE | 1226524 | 10/1966 |
| FR | 2507442 | 12/1982 |
| IT | 1187244 | 12/1987 |
| WO | WO99/45805 | 9/1999 |

* cited by examiner

*Primary Examiner* — Ismael Izaguirre
(74) *Attorney, Agent, or Firm* — Notaro, Michalos & Zaccaria P.C.

(57) ABSTRACT

A machine for forming and ironing folds in cloth has a plate frame on which are fixed a support and pressure system, a template on which the cloth is put, a moving system for moving a blocking plate which blocks the cloth, a guide system for guiding a folding element which folds outer edges of the cloth and an ironing plate. The guide system has a guide profile and a translating arm which is translated in a longitudinal direction and has a roller and a folding element. The arm is under pressure towards the guide profile so that the roller beats and slides along the edge of the guide profile. In this way, the folding element follows the movement of the arm according to the guide profile and moves in the longitudinal direction and a transversal direction.

21 Claims, 14 Drawing Sheets

MACHINE FOR FORMING AND IRONING FOLDS IN PIECES OF CLOTH

The present invention refers, in general, to a machine for forming and ironing folds on pieces of cloth. More particularly, the present invention refers to a machine for folding and ironing edges of pieces of cloth according to predetermined lines so that the pleats remain fixed for the subsequent processes to which the pieces of cloth are subjected.

Said machines are used in the textile sector, more precisely in the field of the cloth working; in particular, these machines are usually utilized to form and iron pockets before sewing them on the other parts of trousers and therefore, these machines are commonly known as pocket ironing machines.

As is known, there exist pocket ironing machines which comprise an ironing plate which translates on a base on which the piece of cloth to be folded according to a defined profile is supported. A rubber template is fixed on the base. The rubber template is hollow and its cavity corresponds with the pocket shape to be obtained.

The machines according to the known art disclose that the piece of cloth, which is bigger than the template cavity, is put on the rubber template.

Folding elements translate so as to lift and fold the edges of the piece of cloth which remain out of the cavity and to obtain a pocket of the wished shape, this shape being identical to the shape of the cavity, the edges being folded only toward the inside without letting any edge of cloth out of the cavity.

Immediately after the folding of the edges, the ironing plate is arranged on the rubber template which is compelled to beat against the plate itself in order to iron the previously obtained pleats and keep them fixed.

In FIGS. 15, 16, the pocket folding phases are represented, the pocket being indicated with reference number 1. In order to obtain a good sewing of the folded, ironed pocket, it is preferable in the folding and ironing operations that at first the side edges 2, 3 of the pocket 1 are folded and then, the lower edge 4 of the pocket 1 is folded.

In order to obtain the pleats according to the so-described succession, the folding elements must be two so that each of them folds a side edge and are translated according to a fixed direction.

In fact, the folding elements are translated according to a main direction, namely, a direction which is longitudinal to the pocket and at the same time, according to a secondary direction, which is perpendicular to the main direction, namely according to a direction which is transversal to the pocket for the folding of the side edges.

In order to allow said movements, the folding elements are fixed on a pneumatic cylinder to obtain a translation according to the main direction, in addition, the same folding elements comprise a pin which slides along a guide which is fixed at the side of the folding elements. Said guide has a curvilinear profile through which it is possible to move the folding elements even according to the secondary direction, which is transversal to the pocket.

The movement according to the transversal direction to the pocket is, therefore, very important. Ideally, an optimal pleat is obtained when the ironing elements reach a certain position in relation to the motion of longitudinal translation and then, they move only according to a transversal direction before restarting their longitudinal motion.

Consequently, the path of the guide has a rather strict curvature, which involves a considerable wear between the pins of the folding elements and the guides in which they slide. For this reason, the machines according to the known art need a continuous maintenance.

In addition, in the pocket ironing machines according to the known art it is necessary to modify the path to be followed by the folding elements for each type of pocket to be shaped and ironed and consequently, it is necessary to substitute the guides.

Consequently, besides requiring a continuous maintenance the pocket ironing machines according to the known art are not very flexible.

An aim of the invention is to remove the above drawbacks and other ones by carrying out a machine requiring only a minimal maintenance.

A further aim of the invention is to carry out a pocket ironing machine which can be utilized for different pocket models without having to substitute any parts of the machine.

All said aims and advantages are reached according to the invention with a machine for forming and ironing folds in pieces of cloth, comprising a plate frame on which there are fixed:

- a support and pressure system for supporting and pressing a template on which the piece of cloth to be worked is put,
- a moving system for moving a blocking plate which blocks the piece of cloth to be worked by beating the template,
- a guide system for guiding at least a folding element which folds the outer edges of the piece of cloth,
- a ironing plate with moving means, which is put on the piece of cloth having the outer edges folded so as to iron said edges in position.

Said machine is characterized in that said guide system comprises at least a guide profile fixed on the plate frame, and at least a translating arm which is translated according to a longitudinal direction by moving means, and comprising a roller and a folding element.

Said at least an arm is under pressure towards the at least a guide profile through pressing means, so that the roller beats and slides along the edge of the at least a guide profile. In this way, the folding element follows the movement of the arm according to the outline of the edge of the guide profile and moves according to the longitudinal direction and a transversal direction.

The presence of one or more arms with a roller sliding on a guide profile avoids the utilization of a system according to the known art in which the folding elements are moved by sliding a pin on a guide, which involves both a wear of the pin and a wear of the guide on which the pin slides.

In fact, the roller, which is carried out, for instance, like a bearing, rolls and beats on the guide profile without a particular friction and therefore, the machine maintenance operations are reduced considerably.

In addition, the arm is pivoted on a point and therefore, besides translating, the arm accomplishes a curvilinear motion which allows to fold the side edges of the pocket more accurately.

As an advantage, the guide profile comprises first positioning means to fix, in a removable way, the same guide profile in variable positions in respect to the plate frame. Said first positioning means can be holes obtained in the plate frame or in elements fixed on the plate frame and pins to be screwed in said holes. The removable positioning of the guide profile in relation to the plate frame allows to vary the movements of the folding elements on the base of the pocket model and kind of pleats to be carried out.

Likewise, the at least an arm comprises second positioning means through which the roller and/or the folding element are fixed in variable positions on said at least an arm in order to further improve the flexibility of utilization of the machine according to the invention.

Besides, the at least an arm is hinged through a pivot to the ironing plate so that the translation of the ironing plate involves a translation of the at least an arm and the number of mechanisms is reduced. In addition, after the folding element has carried out the pleat, the pleat is ironed and fixed.

In order to obtain more versions of utilization, at least two holes are obtained in the at least an arm, in which holes the pivot is fixed to vary the oscillating motion of the at least an arm.

Advantageously, the support and pressure system of the template comprises an adjusting plate on which the template rests, said adjusting plate comprising adjusting means for the adjustment of the height and the inclination of said adjusting plate. In particular, said adjusting plate is connected through a stirrup with the rod of a cylinder in order to lift and press the template and the piece of cloth put on said template against the blocking plate and/or the ironing plate.

The possibility of adjusting the height and the inclination of the adjusting plate allows the piece of cloth on the template to be positioned more accurately in order to obtain a better folding of the edges.

According to the invention, the adjusting plate is supported by the plate frame and said adjusting means comprise at least three screws which are inserted in said adjusting plate so that the adjusting plate is lifted and inclined in respect to said plate frame by screwing or unscrewing at least one of said three screws. The regulation is effected from the top by simply lifting the template and having access to the screw-heads which are screwed and unscrewed without removing any casing or without access from the bottom to the plate frame.

Advantageously, the connecting stirrup between the cylinder rod and the adjusting plate is shaped like a C and comprises a base portion from which two lamellae extend orthogonally, the free ends of said two lamellae being connected with the adjusting plate and the base portion being subjected to the pressure exerted through the rod of the cylinder. In this way, a through opening is obtained between the C-shaped stirrup and the adjusting plate.

According to the invention, the moving means of the ironing plate comprise a cylinder fixed under the plate frame through a stirrup; and end of the rod of said cylinder being fixed through connecting means with the ironing plate, so that a movement of the rod involves a translation of the ironing plate. In particular, the cylinder and/or the rod pass through a through-opening obtained between the C-stirrup and the adjusting plate so as to be arranged longitudinally centrally in respect to the ironing plate. In this way, the ironing plate moves in balance without lateral stresses which will wear out the side ways between which the ironing plate slides.

Advantageously, the moving system of the blocking plate comprises an oscillating arm, an end of which is connected in a rotating way through a pivot with the plate frame while the blocking plate is fixed on the opposite end. In particular, the oscillating arm is connected with the rod of a cylinder fixed through joining means with the plate frame so that by actuating the cylinder, the blocking plate beats on the template or alternatively, the blocking plate is lifted in respect to the template. Said cylinder is arranged over the plate frame in order to avoid any oscillation of the moving system.

Further features and details of the invention will be better understood from the following specification which is given as a non-limiting example on the base of the accompanying drawings wherein.

Figure 1:
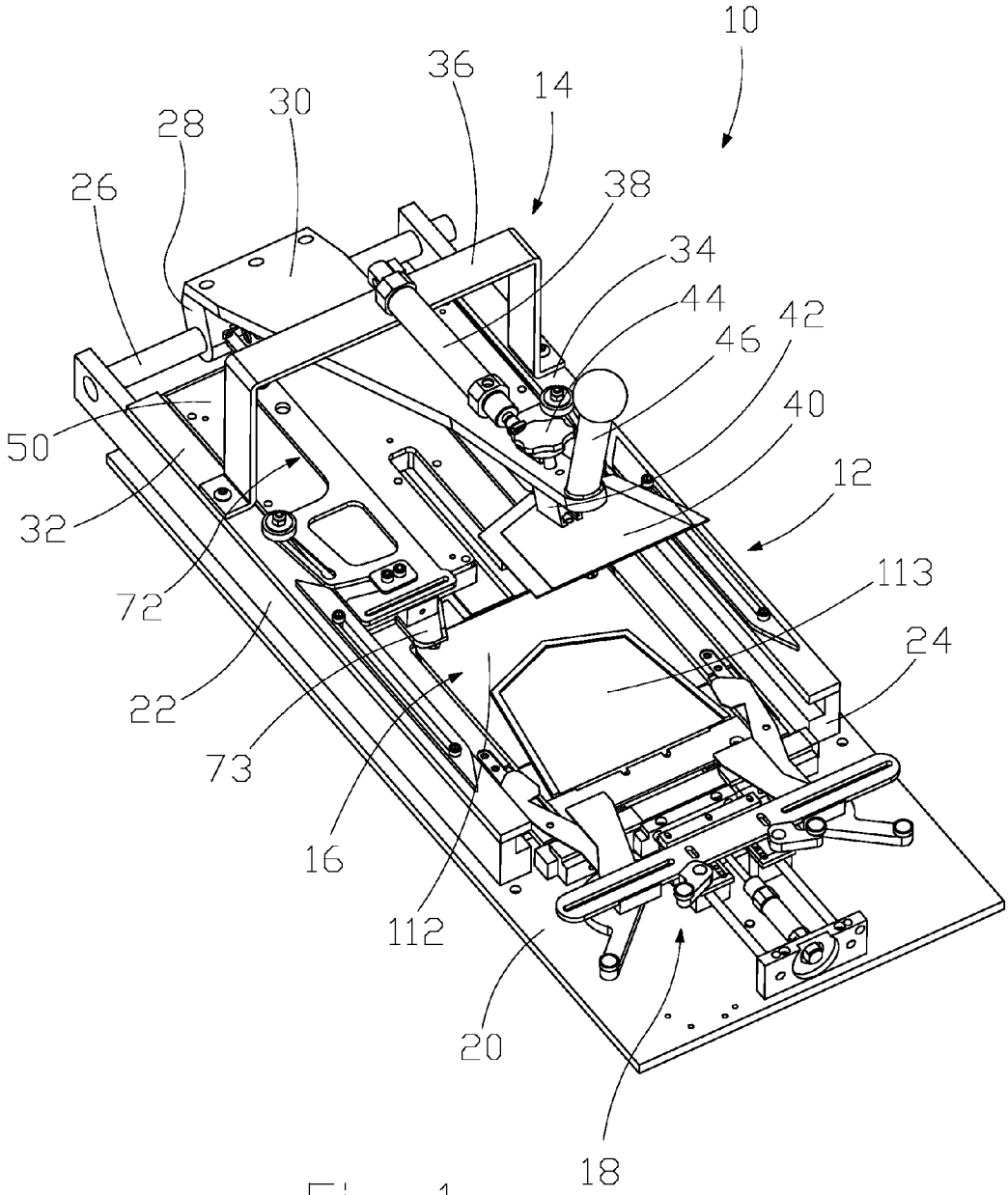
FIGS. 1, 2, 3 are an axonometric top view, a side view and an axonometric bottom view of a pocket ironing machine according to the invention, respectively.
Figure 2:
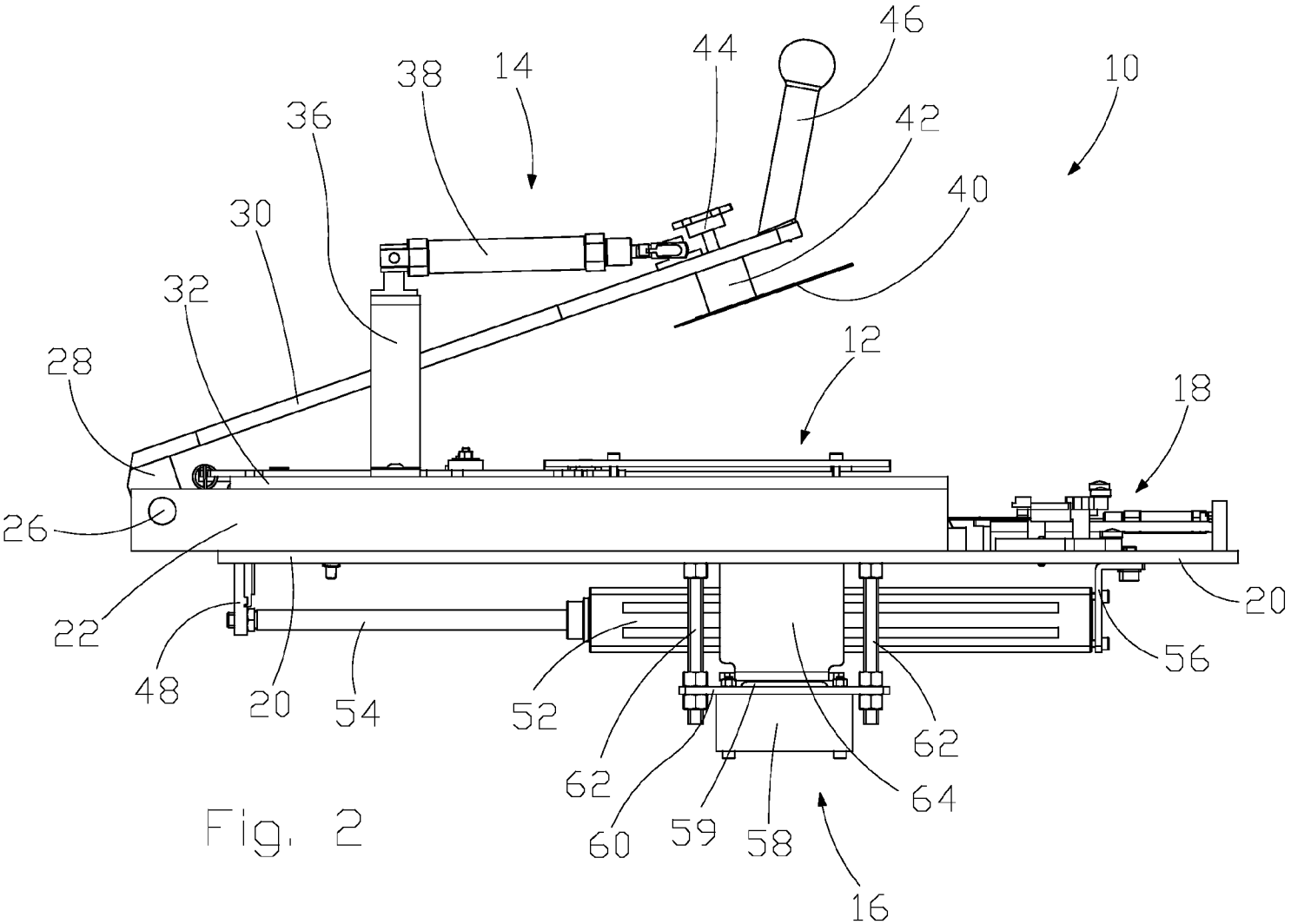
Figure 3:
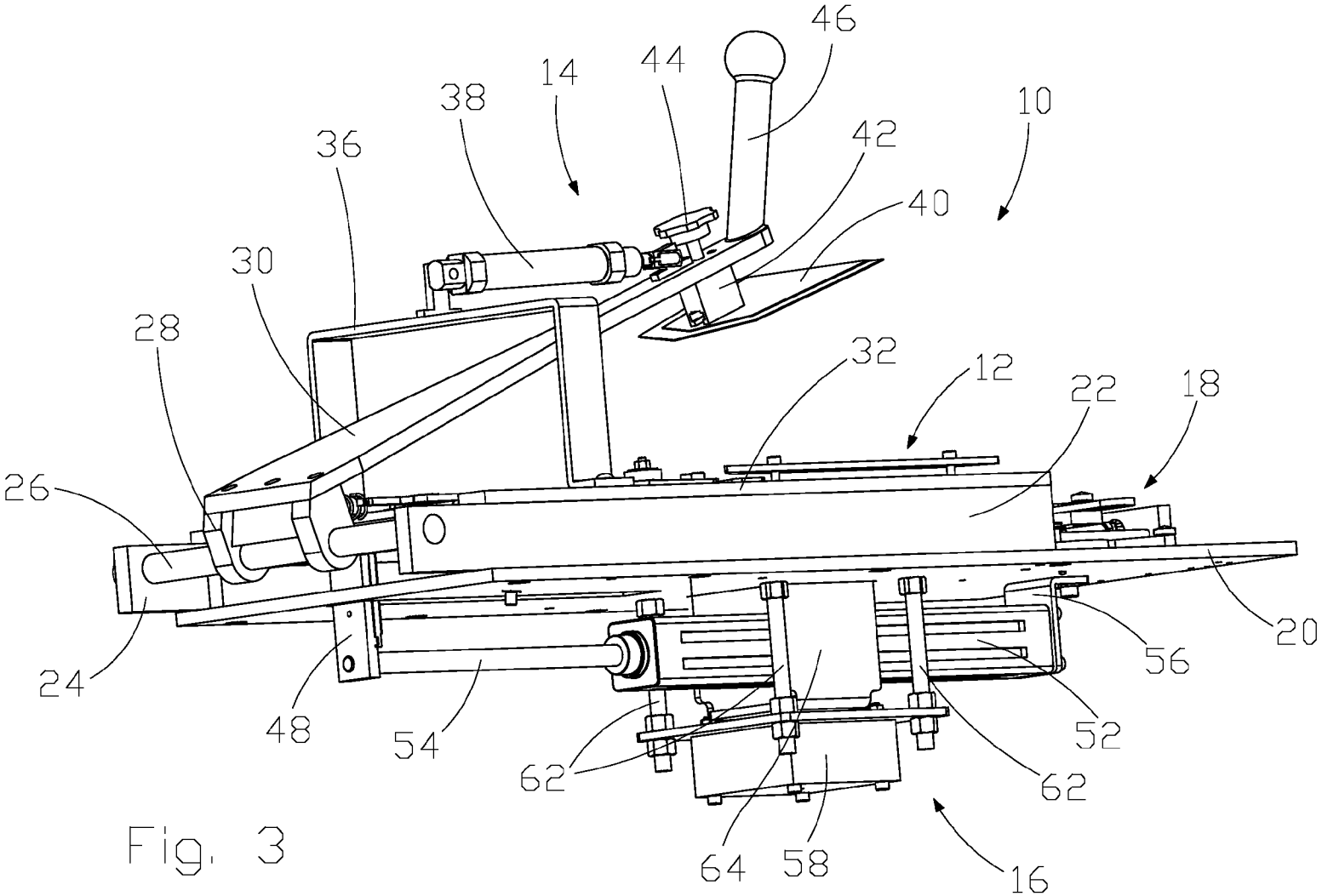
Figure 15:
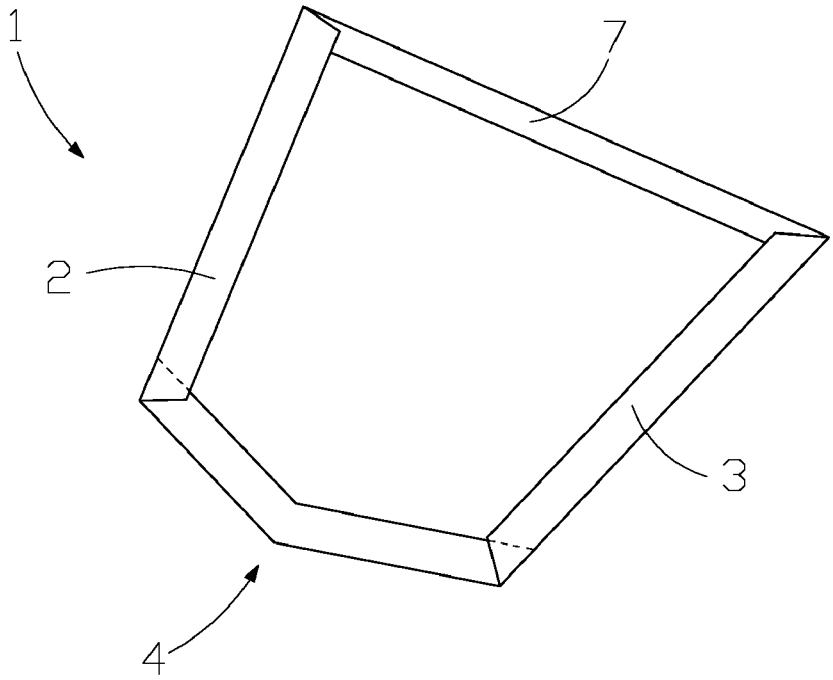
FIG. 15 is an axonometric top view of a pocket in which the side edges have been folded.
Figure 16:
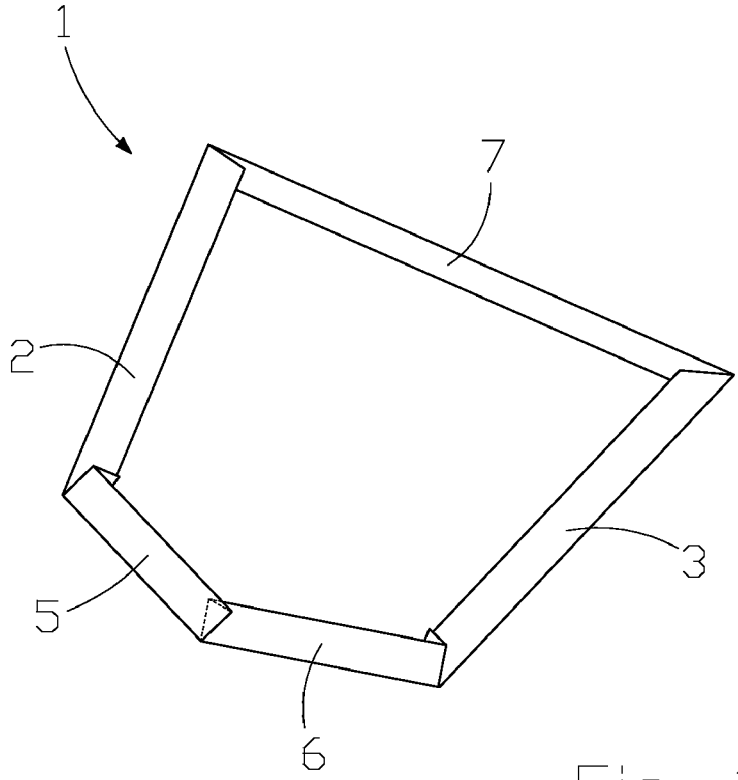
FIG. 16 is an axonometric top view of the pocket in FIG. 15 in which the lower edge has been folded, as well.

With reference to the accompanying drawings, in particular to FIGS. 1, 2, 3, number 10 denotes a pocket ironing machine, adapted to fold 5 the peripheral edges of a piece of cloth inwardly so as to form a pocket 1 as represented in FIGS. 15 and 16. In particular, the pocket 1 has an upper edge 7, which has been already folded and sewn inwardly, and two side edges 2, 3, which have been folded inwardly in the pocket, as well. The lower edge 4 is folded and subdivided into two pieces 5, 6 which overlap the side edges 2, 3 sideways, respectively.

The pocket ironing machine 10 comprises:

- a support and pressure system 16 for supporting and pressing a template 113 on which the piece of cloth to be worked is put,
- a moving system 14 for moving a blocking plate 40 which blocks the piece of cloth to be worked,
- an angle folding system 18,
- a guide system 12 for guiding folding elements 73, 75 and moving elements which move an ironing plate 50, which folding and ironing elements are adapted to fold the outer edges of the piece of cloth and to iron said outer edges in position, respectively.

All the above-mentioned systems are fixed on a plate frame 20 which is provided with suitable supporting legs in order to rest on the ground, not represented in the figures.

Two longitudinal L-sectioned profiles 22, 24 are fixed on the plate frame 20 sideways. A lamella 32, 34 is fixed on the upper part of each of said two longitudinal L-sectioned profiles so that the whole profile shows a C-section.

Figure 8:
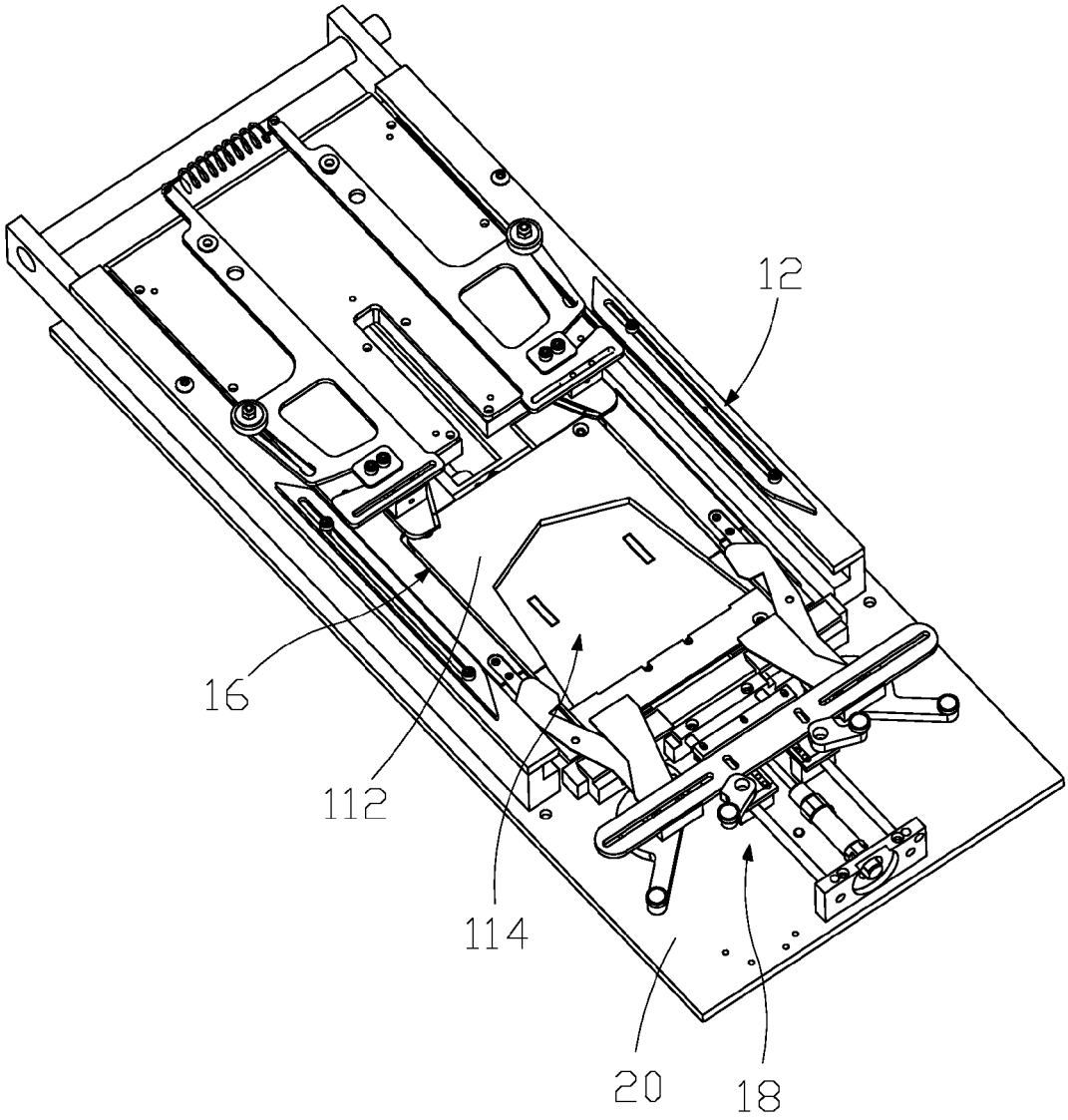
FIG. 8 is an axonometric top view of a part of the machine in FIG. 1 in which it is possible to see a supporting plate for the piece of cloth to be folded and ironed.
Figure 9:
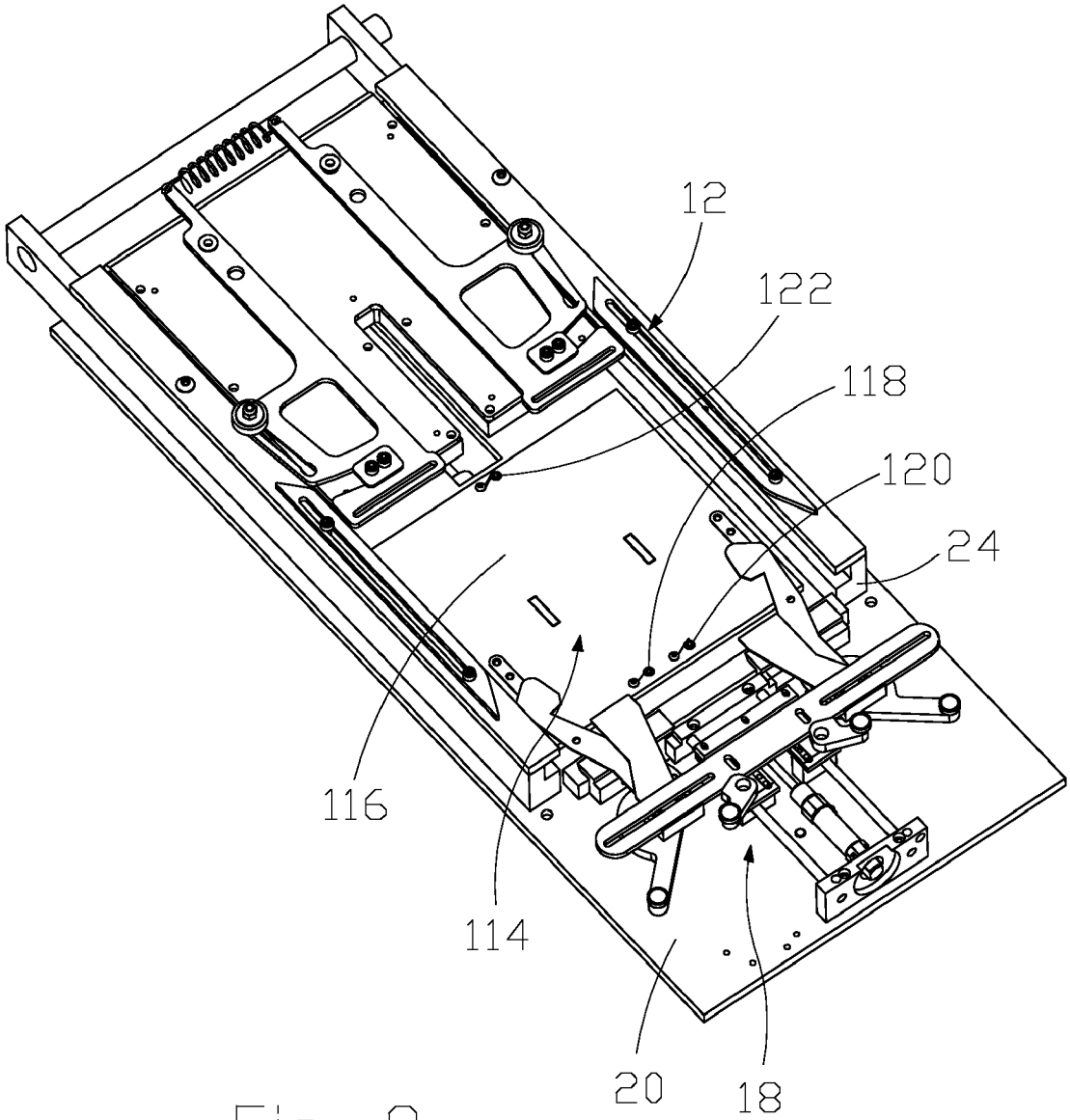
FIG. 9 is an axonometric top view of a part of the machine in FIG. 1, without the supporting plate for the piece of cloth in order to show a plate that is adjustable for height.
Figure 10:
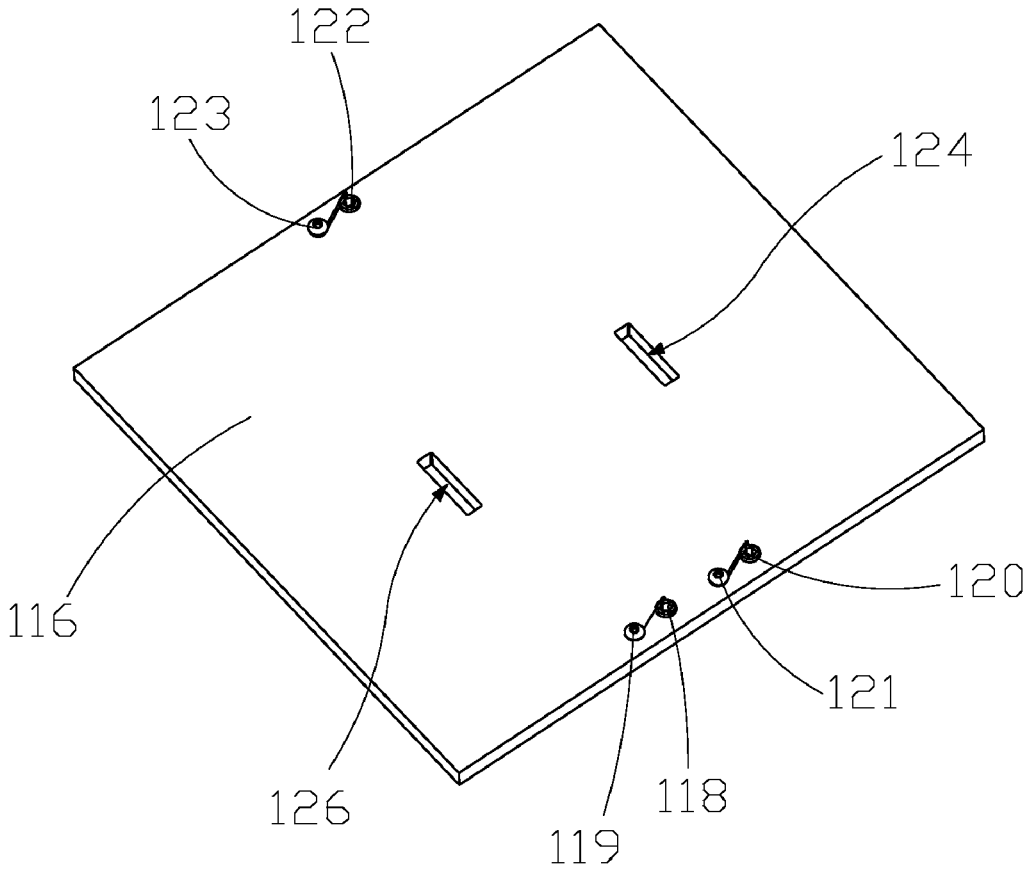
FIGS. 10, 11 are an axonometric top view and an axonometric bottom view of the plate in FIG. 9 that is adjustable for height.
Figure 11:
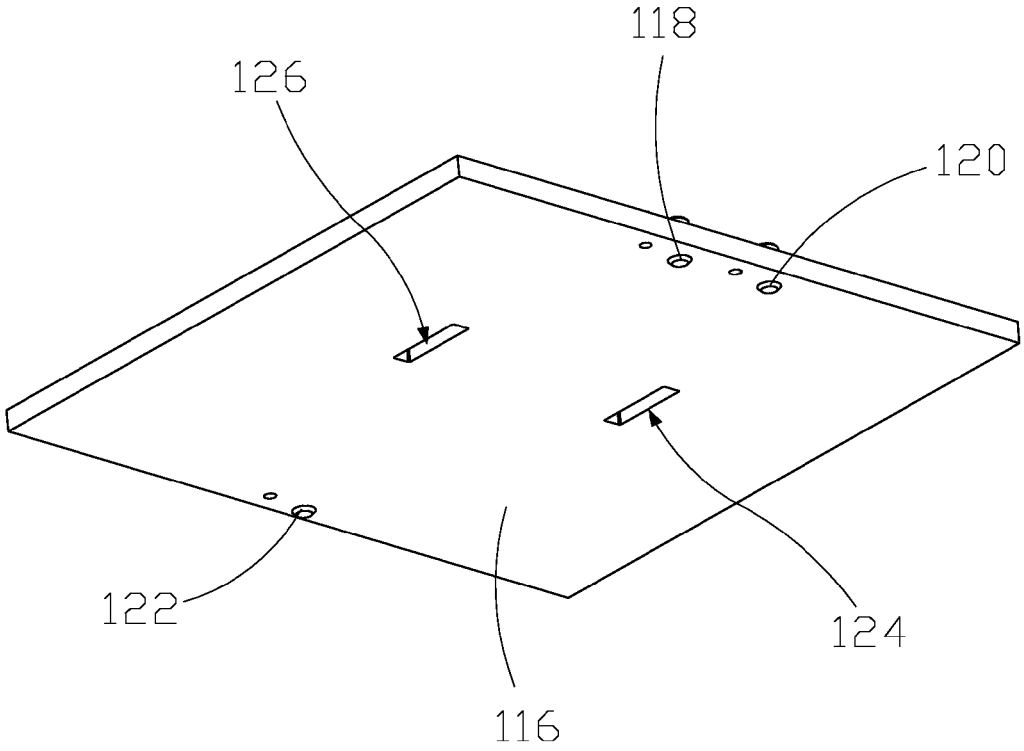

The support and pressure system 16 comprises a rubber template 113 which is received in a cavity 114 which is obtained in a first plate 112 as represented in FIG. 8. In turn, the first plate 112 rests on an adjusting 5 plate 116 as visible in FIGS. 9, 10, 11.

A first threaded hole and a second threaded hole are obtained in the upper part of the adjusting plate 116, next to the folding system 18. A third threaded hole is obtained in the lower part of the adjusting plate 116. A first screw 118, a second screw 120 and a third screw 122 are inserted in said holes, respectively, each of said screws being provided with a respective locking system 119, 121, 123.

By screwing or unscrewing the three screws 118, 120, 122, the ends of which beat on the plate frame 20, the adjusting plate 116 can be lifted and/or inclined around longitudinal and transversal axes in order to adjust the position and the orientation of the first plate 112 and to consequently adjust the position and the orientation of the template 113.

Two grooves 124, 126 are obtained in the adjusting plate 116, the free ends of a C-shaped stirrup 64 being inserted in said two grooves.

A through-opening, not visible in the figures, is obtained under the adjusting plate 116 in the plate frame 20. The dimensions of said through-opening allow the insertion of the free ends of the C-shaped stirrup 64. In this way, the base of the C-shaped stirrup 64 remains under the plate frame 20 while the free ends of the C-shaped stirrup 64 are positioned just over the plate frame 20 since the free ends of the C-shaped stirrup 64 are fixed by means of the adjusting screws 118, 120, 122 on the adjusting plate the perimeter of which rests on the upper surface of the plate frame 20.

As it can be seen in FIGS. 2, 3, the movable end 59 of a pneumatic cylinder 58 beats on the base portion of the C-shaped stirrup 64, said pneumatic cylinder being fixed on a flange 60. In turn, the flange 60 is connected through suitable fixing means 62 with the plate frame 20.

Consequently, when the pneumatic cylinder 58 is actuated, the stirrup 64 is lifted and presses the adjusting plate 116 as well as the first plate 112 and the template 113, on which the piece of cloth to be folded and ironed is put.

The moving system 14 for moving the blocking plate 40 comprises a cylindrical pivot 26 which is fixed on the ends of the longitudinal profiles 22, 24. A stirrup 28 is connected with said cylindrical pivot 26 so as to rotate. An end of a lamellar element 30 is fixed on the stirrup 28. The blocking plate 40 is connected with the opposite end or free end of the lamellar element 30 so as to be adjusted and removed.

In particular, the blocking plate 40 is fixed on a support 42 which is connected through a screw with the lamellar element 30 so as to be removed, said screw being secured by means of a wheel 44.

A knob 46 is fixed on the free end of the lamellar element 30, next to the wheel 44.

The rod of a pneumatic cylinder 38 is connected with the same free end of the lamellar element 30. The pneumatic cylinder 38 is connected with a C-shaped stirrup 36 the lower part of which is fixed on the lamellae 32, 34.

The blocking plate 40 can be lowered or lifted by actuating the cylinder 38.

The cylinder 38 moves the lamellar element 30 which is connected through the stirrup 28 with the cylindrical pivot 26 so as to rotate.

The folding system 18 is fit to fold the upper ends of the side edges 2, 3 of the piece of cloth and is not described below since it is carried out according to the known art.

The guide system 12 for the folding elements 73, 75 and the ironing plate 50 comprises a pneumatic cylinder 52 which is placed under the plate frame 20 and is fixed through an L-stirrup 56 with the plate frame 20, as represented in FIGS. 2, 3. The free end of the rod 54 of the cylinder 52 is united to a connecting piece 48 which in turn is united to the ironing plate 50.

The ironing plate 50, which is actuated by the cylinder 52, can move longitudinally on the plate frame 20 and comprises side projections laterally, not represented in the figures. Said side projections are inserted in the longitudinal cavity that is obtained in the C-sectioned profile which is formed between each of the L-sectioned longitudinal profiles 22, 24 and the respective lamella 32, 34.

The cylinder 52 is arranged longitudinally and centrally in relation to the plate frame 20. This position can be obtained through the shape of the C-shaped stirrup 64 which embraces the cylinder 52. Both the C-shaped stirrup 64 and the pneumatic cylinder 58 are arranged in the middle of the plate frame 20.

The middle position of the cylinder 52 allows a fluid movement of the ironing plate without stressing the ironing plate 50 or the longitudinal cavities, obtained in the C-sectioned side profile, with lateral or tangential forces.

In order to obtain a better sliding of the ironing plate 50 and to limit the wear, slides are provided in the longitudinal cavities. Said slides are made of an anti-friction, heat resistant material, such as Permaglide®.

Figure 4:
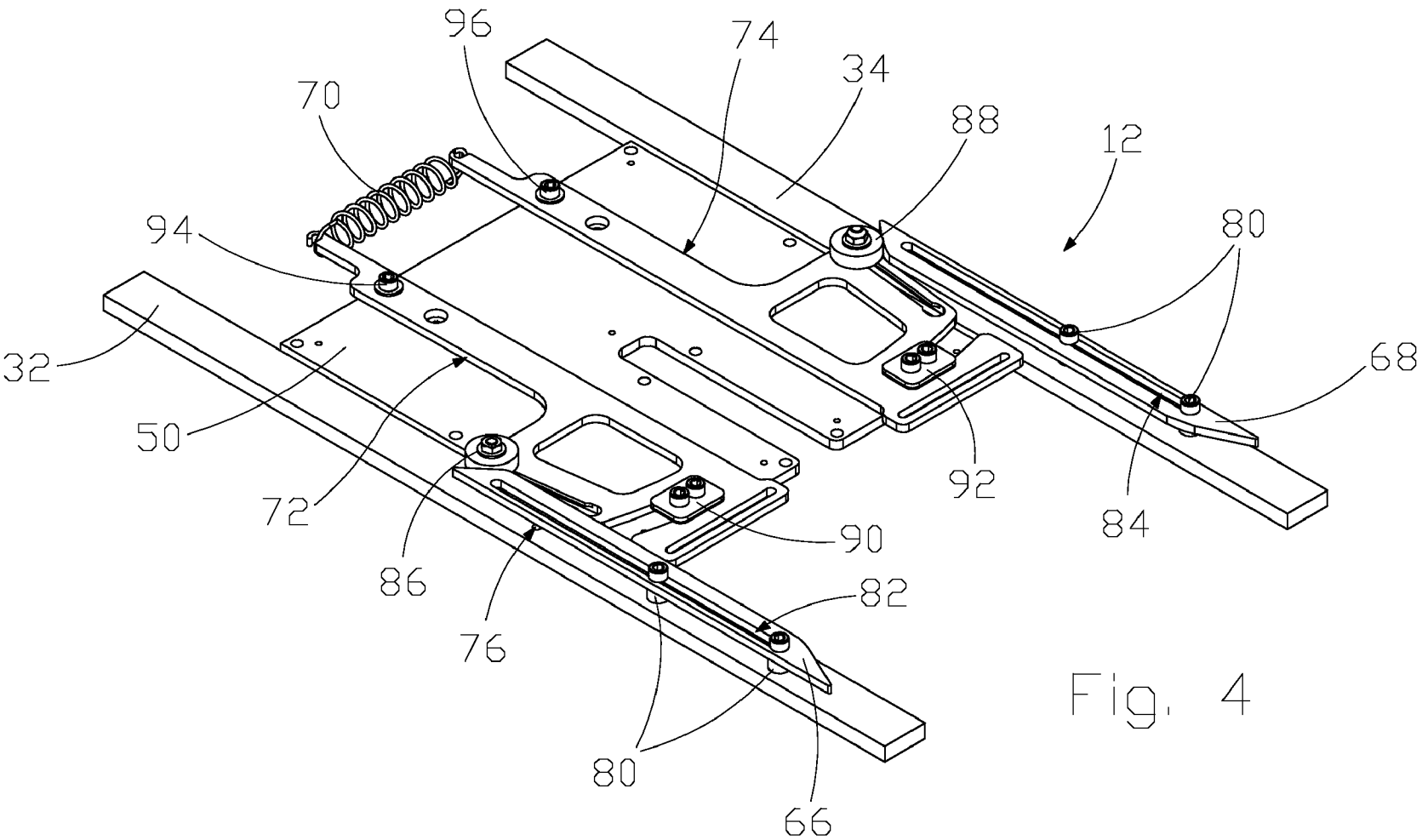
FIGS. 4, 5 are an axonometric top view and a top view of the guide system for the folding elements of the machine in FIG. 1, respectively.
Figure 5:
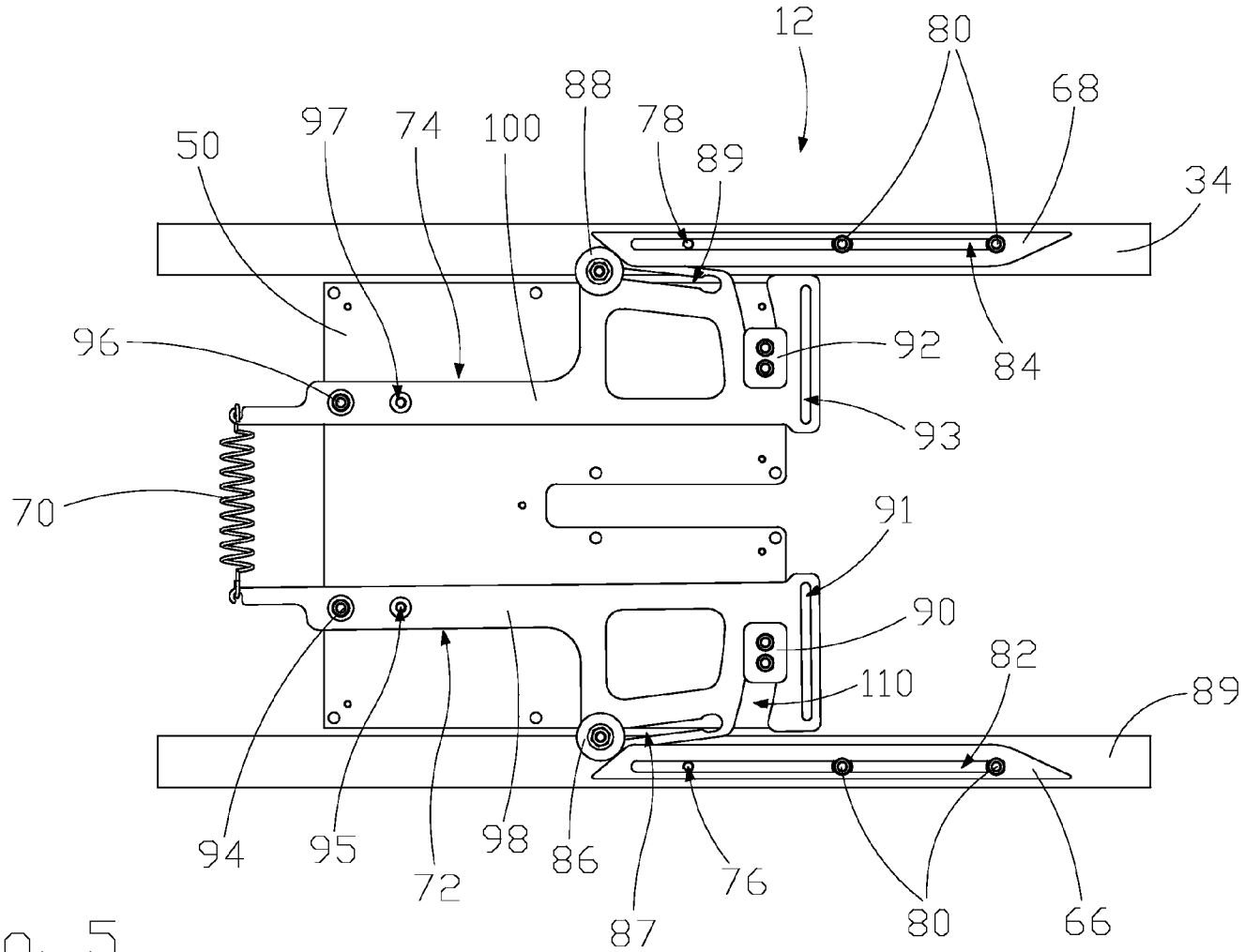

As it appears from FIGS. 4, 5, a first arm 72 and a second arm 74 are pivoted by means of a first pivot 94 and a second pivot 96 to the ironing plate 50, respectively. Their shape is homologous and symmetric. The rear ends of the first arm 72 and the second arm 74 are connected with each other through a spring 70.

Figure 6:
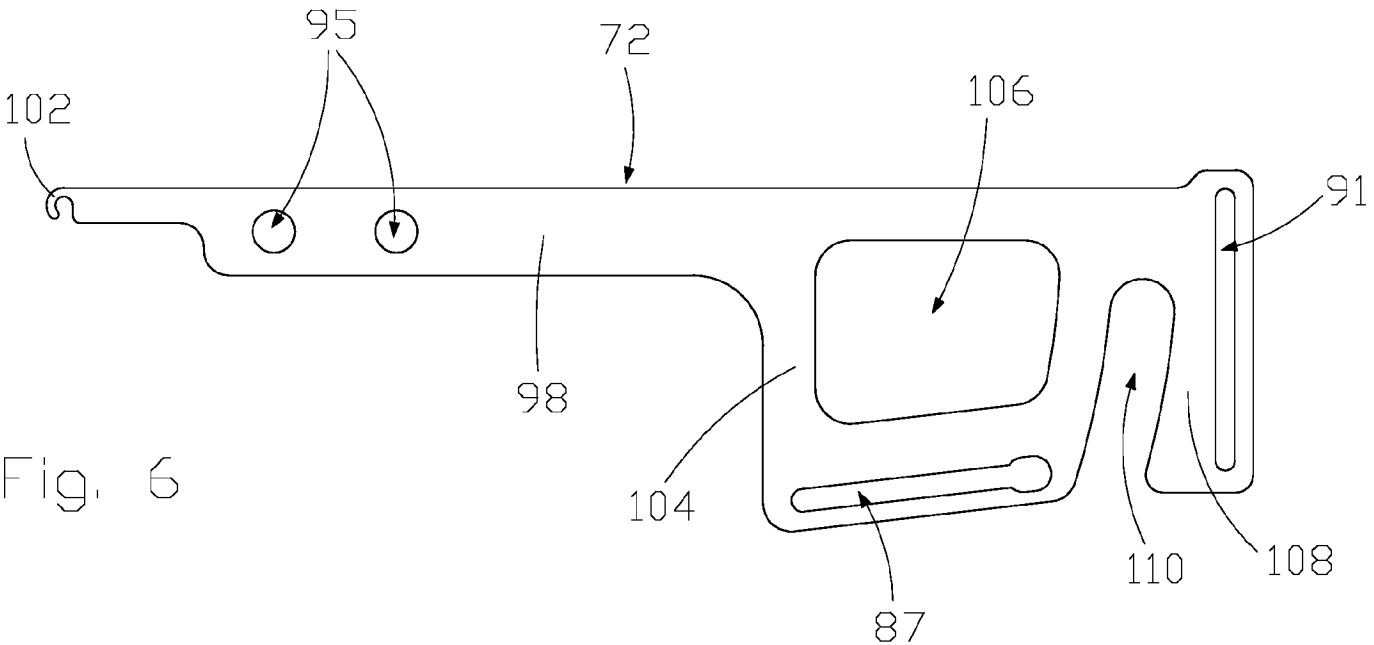
FIGS. 6, 7 show some elements, seen from the top, of the system as represented in FIGS. 4, 5.

As represented in FIG. 6, the first arm 72 comprises a longitudinal lamellar profile 98. An end of this profile is provided with a hook 102 for the fixing of the spring 70. Two holes 95 are obtained in the same end but more internally than the hook 102 and the first pivot 94 is inserted in one of said holes.

On the opposite side to the hook 102, a rectangular profile 104 showing an essentially irregular rectangular shape and a lamellar element 108 are attached to the longitudinal lamellar profile 98, the lamellar element 108 being arranged orthogonally to the longitudinal lamellar profile 98. The rectangular profile 104 and the lamellar element 108 are separated by a curve opening 110.

A lightening through-opening 106 and an oblong hole 87 are obtained in the rectangular profile 104, the direction of the oblong hole 87 being inclined in relation to the direction of longitudinal development of the longitudinal lamellar profile 98.

A second oblong hole 91 is obtained in the lamellar element 108.

Figure 13:
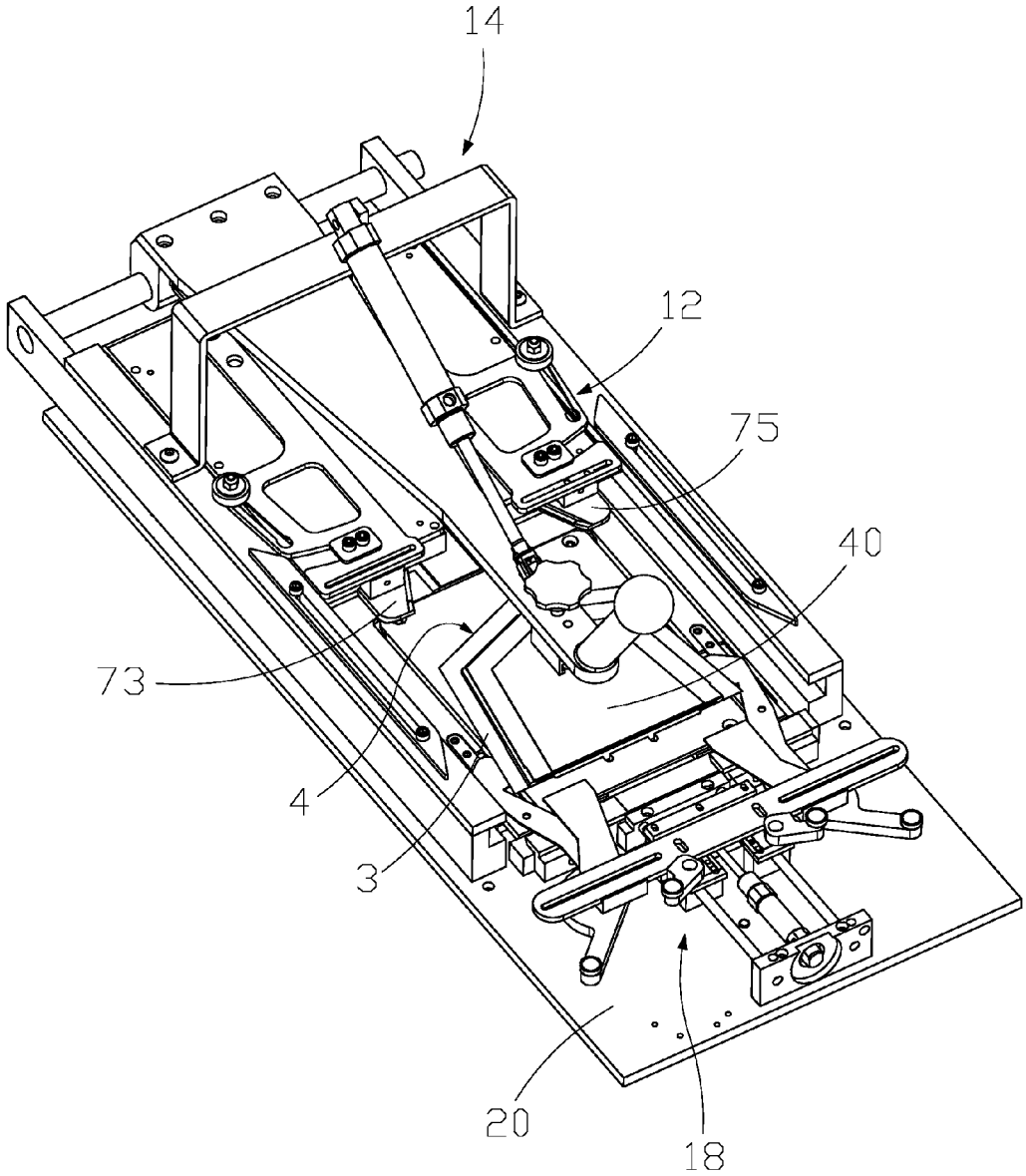
FIG. 13 is an axonometric top view of the machine according to the invention in a second working phase.

As it appears from FIGS. 4, 5, a roller bearing 86 is bound to the oblong hole 87 according to a selected position while the folding element 73 is fixed on the second oblong hole 91, in front of the ironing plate 50, as visible in FIGS. 1, 13.

Likewise, the second arm 74, the configuration of which is analogous and symmetric to the first arm 72, comprises a roller bearing 88 which is fixed in a selected position in the oblong hole 89, and the folding element 75 is constrained in the second oblong hole 93 as it can be seen in FIG. 13.

The spring 70 is preloaded so that the free ends of the first arm 72 and the second arm 74 tend to retract from each other. A first locking 5 plate 90 and a second locking plate 92 are fixed on the ironing plate 50 in such a position to be received in the curved openings 110 of the first arm 72 and the second arm 74. Said locking plates 90, 92 lock the first and second arms in the position of widest retraction. In addition, said locking plates 90, 92 act as shim adjustment guides for a shim adjustment to a given clearance to prevent the arms 72, 74 to vertically tilt or to swing according to an orthogonal direction to the plate frame 20. Like the sliding profiles for the ironing plate 50, the locking plates 90, 92 are provided, on the lower part, with slides in an anti-friction material. These slides are in touch with the arms 72, 74.

As represented in FIGS. 4, 5, three holes 76 are obtained in the first lamella 32 (only one hole is represented) and three holes 78 are obtained in the second lamella 34 (only one hole is represented).

Figure 7:
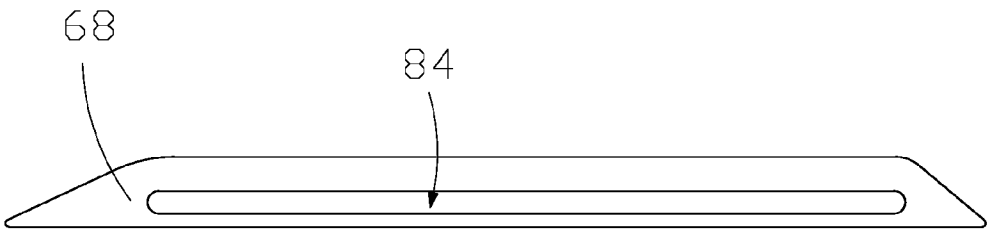

A first guide profile 66 is fixed on the first lamella 32 through a pair of pivots 80 which pass through an oblong opening 82 which is obtained in the first guide profile 66 (represented in FIG. 7). The pivots 80 are screwed in two holes 76 of the first lamella 32. Likewise, a second guide profile 68 is fixed on the second lamella 34 through a pair of pivots 80 which pass through an oblong opening 84 which is obtained in the second guide profile 68. These pivots 80 are screwed in two holes 78 of the second lamella 34.

As it appears from FIGS. 4, 5, as the ironing plate 50 advances, the roller bearings 86, 88 roll laterally and beat on the first guide profile 66 and the second guide profile 68, respectively, on following their outline. Since the roller bearings 86, 88 are fixed on the first arm 72 and the second arm 74, respectively, the roller bearings 86, 88 compel the ends of the arms 72, 74 to approach to each other. In this way, besides moving longitudinally, the folding elements 73, 75, which are fixed on the ends of the arms 72, 74, shift transversally. This transversal displacement allows the side edges 2, 3 of the pocket 1 in FIG. 15 to be folded.

The guide system 12 is very flexible and adjustable. In fact, the position and the movement of the folding elements 73, 75 can be modified according to the need of the operator, for instance on the base of the shape of the pocket to be folded and ironed.

The arms 72, 74 can be pivoted on the ironing plate 50 by passing the pivots 94, 96 through one of the two holes 95, 97, reducing or increasing the distance the distance between the pivots 94, 96 and the ends on which the folding elements 73, 75 are fixed.

The positions of the first guide profile 66 and the second guide profile 68 relative to the first lamella 32 and the second lamella 34, respectively, can be adjusted by fixing the pivots 80 in different positions, the pivots 80 being inserted in two of the three holes 76, 78 in the lamellae 32, 34 and passing through the oblong openings 82, 84 in the guide profiles 66, 68.

For a better flexibility, the ends of the guide profiles 66, 68 have inclined edges which follow two different inclinations. In this way, it is possible to obtain two different movements of the arms 72, 74 and the relative folding elements 73, 75 with the same profile.

Even the roller bearings 86, 88 can be fixed in different positions in the oblong holes 87, 89, respectively. Besides, the inclination of the oblong holes 87, 89 in which the roller bearings 86, 89 are fixed allows to regulate the speed of transversal displacement of the arms 72, 74 and consequently of the folding elements 73, 75.

Likewise, even the folding elements 73, 75 can be mounted in a variable position relative to the arms 72, 74 by fixing the folding elements 73, 75 in the second oblong holes 91, 93.

The pocket ironing machine 10 comprises control and governing means for the several moving components such as the cylinders 38, 52, 58, the folding system 18 and the temperatures of the ironing plate 50.

Figure 12:
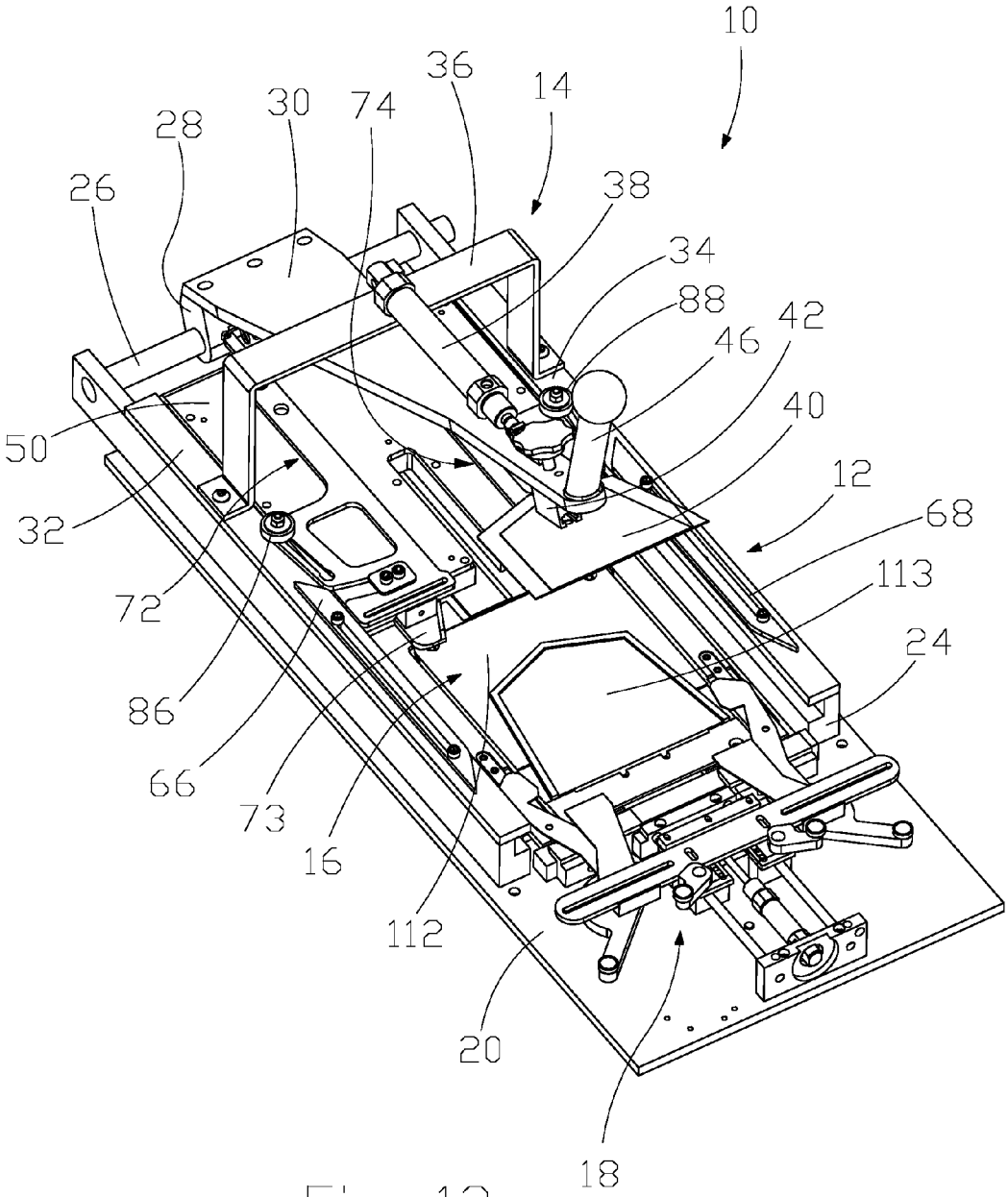
FIG. 12 is an axonometric top view of the machine according to the invention in a first working phase.

The working of the pocket ironing machine according to the invention is explained below, in particular with reference to FIGS. 12, 13, 14.

Before starting the working of the piece of cloth, the operator can regulate the position of the first plate 112 as regards height and inclination by screwing or unscrewing the three adjusting screws 118, 120 122 in the adjusting plate 116. Then, the template 113 is positioned on said first plate 112.

The first plate 112 and the relative template 113 as well as the blocking plate 40 are selected according to the shape of the pockets to be obtained.

Likewise, the folding elements 73, 75 are selected according to the shape of the pocket to be folded and ironed. In the same way, the operator can decide on the movement of the folding elements 73, 75 relative to the piece of cloth to be worked by regulating the position of the folding elements 73, 75 and the roller bearings 86, 88 on the arms 72, 74. Said movement is modified by utilizing different guide profiles 66, 68 or by varying the position of same along the lamellae 32, 34.

Once all said selections and adjustments have been done, the operator positions the piece of cloth to be folded on the template 113. The moving system 14 for the blocking plate 40 is in its position of rest, namely the blocking plate 40 is lifted in relation to the template 113 since the rod of the cylinder 38 is kept in the inside of the cylinder 38.

The operator pulls a knob 46 slightly downwards and actuates a sensor of the moving system 14: the pneumatic cylinder 38 is actuated by extending the rod of the cylinder 38.

The blocking plate 40 is positioned slightly over the piece of cloth to be worked as it appears from FIG. 13 in order to allow a better positioning of the piece of cloth, if necessary.

Then, the operator puts the ironing plate 50 and the arms 72, 74 into motion; by causing said motion, the blocking plate 40 is further lowered so as to beat on the template 113 and block the piece of cloth to be folded.

The advancing of the ironing plate 50, which is brought at the wished ironing temperature, is obtained through the cylinder which retracts the rod 54.

As the ironing plate 50 is moved, the folding elements 73, 75 advance, as well and fold the side edges 2, 3 of the pocket 1. Said movement is obtained through the longitudinal translation and the approaching of the arms 72, 74.

The approaching of the arms 72, 74 is obtained by sliding the roller bearings 86, 88 along the side edge of the guide profiles 66, 68.

During the advancement of the ironing plate 50, the cylinder 58 is actuated by lifting the C-shaped stirrup 64, the adjusting plate 116, the first plate 112 and, consequently, the template 113.

Figure 14:
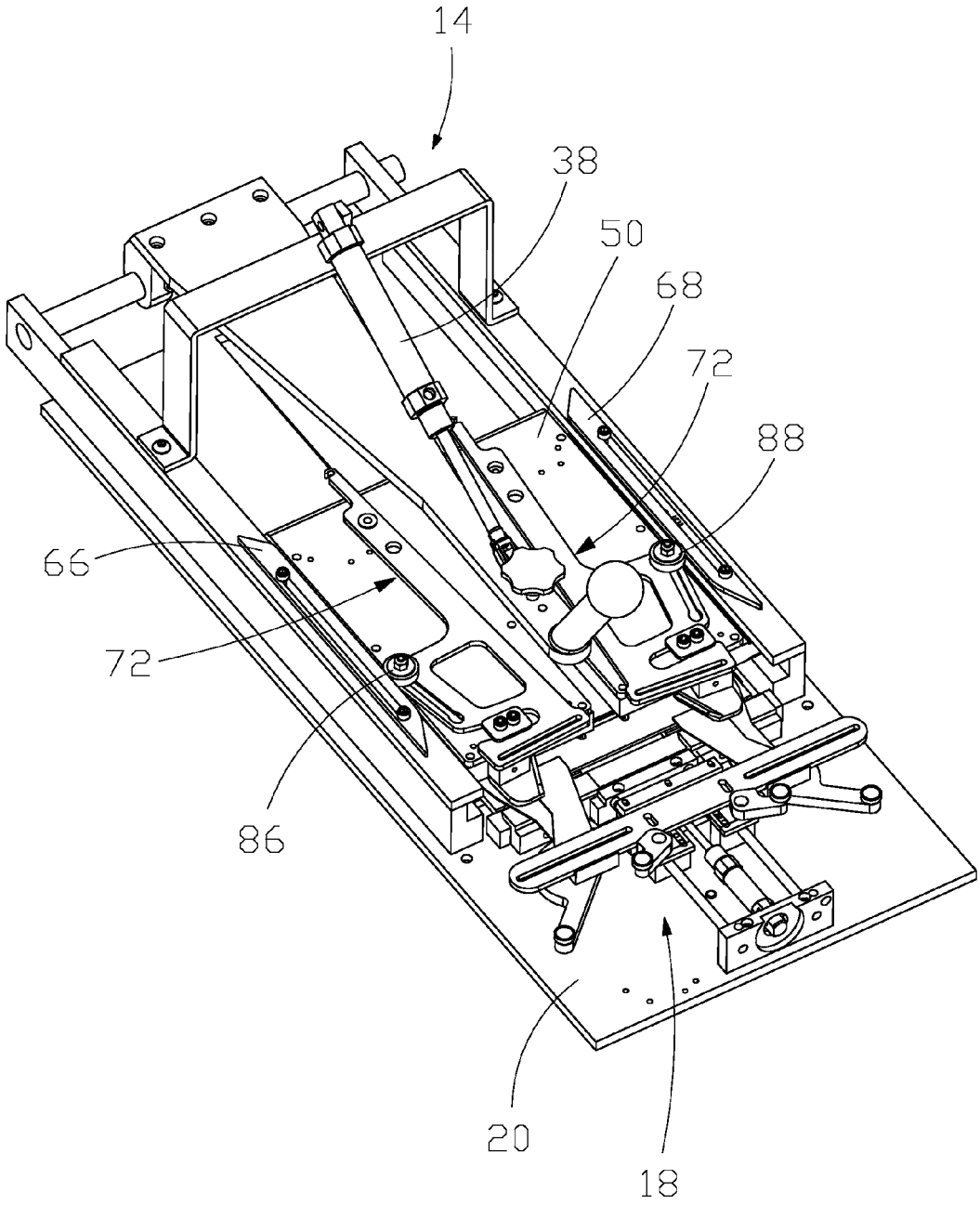
FIG. 14 is an axonometric top view of the machine according to the invention in a third working phase.

At the same time, the cylinder 38 idles and therefore, at the end of the translation of the ironing plate 50, as represented in FIG. 14, the pocket 1 is folded and pressed between the ironing plate 50 and the template 113 so that an efficient ironing is obtained.

In the final phase of the translation of the ironing plate 50, further folding elements, not visible in the figures and carried out according to the known art, fold the lower edge 4 of the pocket 1 in order to obtain two pieces 5, 6 which overlap the side edges 2, 3.

Then, the cylinder 58 is released and the ironing plate 50 is drawing back by extracting the rod 54 from the cylinder 52. In order to maintain the folded pocket in position during the retraction of the ironing plate, the cylinder 38 pushes the blocking plate 40 which beats on the pocket and the template 113.

Finally, the blocking plate 40 is lifted manually or automatically from the template 113 by actuating the cylinder 38 so that the folded, ironed pocket is accessible for the operator who can take the pocket for the subsequent working.

The invention has been described according to an embodiment but it is evident that the scope of protection is to be extended to all the modifications that do not alter the inventive concept as defined by the following claims.

For instance, the pocket ironing machine can comprise two or more ironing heads to fold and iron two pockets simultaneously.

The invention claimed is:

1. Machine (10) for forming and ironing folds in pieces of cloth, comprising a plate frame (20) on which there are fixed:

a support and pressure system (16) for supporting and pressing a template (112, 113) on which the piece of cloth to be worked is put, a moving system (14) for moving a blocking plate (40) which blocks the piece of cloth to be worked by beating the template (112, 113), a guide system (12) for guiding at least a folding element (73, 75) which folds the outer edges of the piece of cloth, an ironing plate (50) with moving means (48, 52, 54), which is put on the piece of cloth having the outer edges folded so as to iron said edges in position, characterized in that said guide system (12) comprises at least a guide profile (66, 68) fixed on the plate frame (20), and at least a translating arm (72, 74) which is translated according to a longitudinal direction by moving means (48, 50, 52, 54), and comprising a roller (86, 88) and a folding element (73, 75), said at least an arm (72, 74) being under pressure towards the at least a guide profile (66, 68) through pressing means (70), so that the roller (86, 88) beats and slides along the edge of the at least a guide profile (66, 68) and the folding element (73, 75) follows the movement of the at least an arm (72, 74) according to the outline of the edge of the guide profile (66, 68) and moves according to the longitudinal direction and a transversal direction.

2. Machine according to claim 1, wherein the at least a guide profile (66, 68) comprises first positioning means (76, 78, 80) to removeably fix the at least a guide profile (66, 68) in variable positions in respect to the plate frame (20).

3. Machine according to claim 1, wherein the at least an arm (72, 74) comprises second positioning means (87, 88, 91, 93) through which the roller (86, 88) and/or the folding element (73, 75) are fixed in variable positions on said at least an arm (72, 74).

4. Machine according to claim 2, wherein the at least an arm (72, 74) comprises second positioning means (87, 88, 91, 93) through which the roller (86, 88) and/or the folding element (73, 75) are fixed in variable positions on said at least an arm (72, 74).

5. Machine according to claim 2, wherein the at least an arm (72, 74) is hinged through a pivot (94, 96) to the ironing plate (50).

6. Machine according to claim 3, wherein the at least an arm (72, 74) is hinged through a pivot (94, 96) to the ironing plate (50).

7. Machine according to claim 4, wherein the at least an arm (72, 74) is hinged through a pivot (94, 96) to the ironing plate (50).

8. Machine according to claim 5, wherein at least two holes (95, 97) are obtained in the at least an arm (72, 74), in which holes the pivot (94, 96) is fixed to vary the oscillating motion of the at least an arm (72, 74).

9. Machine according to claim 6, wherein at least two holes (95, 97) are obtained in the at least an arm (72, 74), in which holes the pivot (94, 96) is fixed to vary the oscillating motion of the at least an arm (72, 74).

10. Machine according to claim 7, wherein at least two holes (95, 97) are obtained in the at least an arm (72, 74), in which holes the pivot (94, 96) is fixed to vary the oscillating motion of the at least an arm (72, 74).

11. Machine according to claim 1, wherein the support and pressure system (16) of the template (112, 113) comprises an adjusting plate (116) on which the template (112, 113) rests, said adjusting plate (116) comprising adjusting means (118, 120, 122), adjustable from the top, for adjusting the height and the inclination of said adjusting plate (116), said adjusting plate (116) being connected through a stirrup (64) with the rod (59) of a cylinder (58) in order to lift and press the template (112, 113) and the piece of 5 cloth put on said template (112, 113) against the blocking plate (40) and/or the ironing plate (50).

12. Machine according to claim 10, wherein the support and pressure system (16) of the template (112, 113) comprises an adjusting plate (116) on which the template (112, 113) rests, said adjusting plate (116) comprising adjusting means (118, 120, 122), adjustable from the top, for adjusting the height and the inclination of said adjusting plate (116), said adjusting plate (116) being connected through a stirrup (64) with the rod (59) of a cylinder (58) in order to lift and press the template (112, 113) and the piece of cloth put on said template (112, 113) against the blocking plate (40) and/or the ironing plate (50).

13. Machine according to claim 11, wherein the adjusting plate (116) is supported by the plate frame (20) and said adjusting means comprise at least three screws (118, 120, 122) which are inserted in said adjusting plate (116) so that the adjusting plate (116) is lifted and inclined in respect to said plate frame (20) by screwing or unscrewing at least one of said three screws (118, 120, 122); said three screws (118, 120, 122) having their screw-heads turned towards the top part of the plate frame (20), so that they can be screwed or unscrewed after lifting the template (112, 113).

14. Machine according to claim 12, wherein the adjusting plate (116) is supported by the plate frame (20) and said adjusting means comprise at least three screws (118, 120, 122) which are inserted in said adjusting plate (116) so that the adjusting plate (116) is lifted and inclined in respect to said plate frame (20) by screwing or unscrewing at least one of said three screws (118, 120, 122); said three screws (118, 120, 122) having their screw-heads turned towards the top part of the plate frame (20), so that they can be screwed or unscrewed after lifting the template (112, 113).

15. Machine according to claim 11, wherein said stirrup (64) is shaped like a C and comprises a base portion from which two lamellae extend orthogonally, the free ends of said two lamellae being connected with the adjusting plate (116) and the base portion being subjected to the pressure exerted through the rod (59) of the cylinder (58).

16. Machine according to claim 13, wherein said stirrup (64) is shaped like a C and comprises a base portion from which two lamellae extend orthogonally, the free ends of said two lamellae being connected with the adjusting plate (116) and the base portion being subjected to the pressure exerted through the rod (59) of the cylinder (58).

17. Machine according to claim 14, wherein said stirrup (64) is shaped like a C and comprises a base portion from which two lamellae extend orthogonally, the free ends of said two lamellae being connected with the adjusting plate (116) and the base portion being subjected to the pressure exerted through the rod (59) of the cylinder (58).

18. Machine according to claim 15, wherein the moving means of the ironing plate (50) comprise a cylinder (52) fixed under the plate frame (20) through a stirrup (56), an end of the rod (54) of said cylinder being fixed through connecting means (48) with the ironing plate (50), so that a movement of the rod (54) involves a translation of the ironing plate (50); said cylinder (52) and/or said rod (54) pass through a through-opening obtained between the C-stirrup (64) and the adjusting plate (116), said cylinder (52) being put centrally in respect to the ironing plate (50) in order to move 5 said ironing plate (50) in balance without stressing said ironing plate (50) with lateral forces.

19. Machine according to claim 17, wherein the moving means of the ironing plate (50) comprise a cylinder (52) fixed under the plate frame (20) through a stirrup (56), an end of the rod (54) of said cylinder being fixed through connecting means (48) with the ironing plate (50), so that a movement of the rod (54) involves a translation of the ironing plate (50); said cylinder (52) and/or said rod (54) pass through a through-opening obtained between the C-stirrup (64) and the adjusting plate (116), said cylinder (52) being put centrally in respect to the ironing plate (50) in order to move said ironing plate (50) in balance without stressing said ironing plate (50) with lateral forces.

20. Machine according to claim 18, wherein the moving system (14) of the blocking plate (40) comprises an oscillating arm (28, 30), an end of which being rotatingly connected through a pivot (26) with the plate frame (20) and the blocking plate (40) being fixed on the opposite end; said oscillating arm being connected with the rod of a cylinder (38) fixed through joining means (36) with the plate frame (20) so that by actuating the cylinder (38), the blocking plate (40) beats on the template (112, 113) or alternatively, the blocking plate (40) is lifted in respect to the template (112, 113), said cylinder (38) being arranged over the plate frame (20).

21. Machine according to claim 19, wherein the moving system (14) of the blocking plate (40) comprises an oscillating arm (28, 30), an end of which being rotatingly connected through a pivot (26) with the plate frame (20) and the blocking plate (40) being fixed on the opposite end; said oscillating arm being connected with the rod of a cylinder (38) fixed through joining means (36) with the plate frame (20) so that by actuating the cylinder (38), the blocking plate (40) beats on the template (112, 113) or alternatively, the blocking plate (40) is lifted in respect to the template (112, 113), said cylinder (38) being arranged over the plate frame (20).

* * * * *